US010837231B2

(12) United States Patent
Pikowski et al.

(10) Patent No.: US 10,837,231 B2
(45) Date of Patent: Nov. 17, 2020

(54) DOUBLE HEAD DRILLING DEVICE AND METHOD FOR PRODUCING A BORE

(71) Applicant: EURODRILL GmbH, Drolshagen (DE)

(72) Inventors: Andreas Pikowski, Drolshagen (DE); Markus Merzhaeuser, Olpe (DE); Henrik Uelhoff, Drolshagen-Herpel (DE)

(73) Assignee: EURODRILL GmbH, Drolshagen (DE)

( * ) Notice: Subject to any disclaimer, the term of this patent is extended or adjusted under 35 U.S.C. 154(b) by 146 days.

(21) Appl. No.: 16/112,428

(22) Filed: Aug. 24, 2018

(65) Prior Publication Data

US 2019/0085638 A1 Mar. 21, 2019

(30) Foreign Application Priority Data

Sep. 19, 2017 (EP) ..... 17191865

(51) Int. Cl.
*E21B 3/02* (2006.01)
*E21B 19/00* (2006.01)
(Continued)

(52) U.S. Cl.
CPC ..... *E21B 3/02* (2013.01); *E21B 7/002* (2013.01); *E21B 7/02* (2013.01); *E21B 7/20* (2013.01)

(58) Field of Classification Search
CPC . E21B 3/02; E21B 19/00; E21B 19/24; E21B 7/02
See application file for complete search history.

(56) References Cited

U.S. PATENT DOCUMENTS 7,770,659 B2 * 8/2010 Uelhoff ..... E21B 7/002 173/1
9,598,905 B2 * 3/2017 Van Zee ..... E21B 3/02
(Continued)

FOREIGN PATENT DOCUMENTS

DE 10 2006 023 505 A1 11/2007
DE 10 2006 059 171 B3 4/2008
(Continued)

OTHER PUBLICATIONS

European Search Report issued by the European Patent Office dated Mar. 20, 2018, which corresponds to European Patent Application No. 17 19 1865.
(Continued)

*Primary Examiner* — Catherine Loikith
(74) *Attorney, Agent, or Firm* — Studebaker & Brackett PC

(57) ABSTRACT

The invention relates to a double head drilling device for a drill rod having an outer pipe and an inner rod running at least in sections inside the outer pipe, with a first drive unit for driving the inner rod in a rotating manner and a second drive unit for driving the outer pipe in a rotating manner. According to the invention provision is made in that for the releasable clamping of the inner rod a first clamping head and a second clamping head are provided and in that the two clamping heads are supported in an axially displaceable manner with respect to each other. Furthermore, the invention also comprises a method for producing a bore with this double head drilling device.

12 Claims, 3 Drawing Sheets

(51) Int. Cl.

| | |
|---|---|
| ***E21B 7/02*** | (2006.01) |
| ***E21B 19/24*** | (2006.01) |
| ***E21B 7/00*** | (2006.01) |
| ***E21B 7/20*** | (2006.01) |

(56) References Cited

U.S. PATENT DOCUMENTS

| | | | |
|---|---|---|---|
| 2008/0164044 | A1 | 7/2008 | Uelhoff et al. |
| 2013/0068490 | A1 | 3/2013 | Van Zee et al. |

FOREIGN PATENT DOCUMENTS

| | | | |
|---|---|---|---|
| DE | 10 2007 012 055 | A1 | 9/2008 |
| DE | 10 2015 001 720 | A1 | 8/2016 |
| EP | 1 936 109 | A1 | 6/2008 |
| EP | 2 236 734 | B1 | 8/2011 |
| EP | 2 295 645 | B1 | 5/2012 |
| JP | H03125785 | A | 5/1991 |
| JP | H06221075 | A | 8/1994 |
| JP | H06079897 | U | 11/1994 |
| JP | H07324326 | A | 12/1995 |
| JP | H08068289 | A | 3/1996 |
| JP | 2011231467 | A | 11/2011 |
| WO | 2010/101987 | A2 | 9/2010 |
| WO | 2011/146490 | A1 | 11/2011 |

OTHER PUBLICATIONS

An Office Action mailed by the Japanese Patent Office dated Jul. 23, 2019, which corresponds to Japanese Patent Application No. 2018-170324 and is related to U.S. Appl. No. 16/112,428.

An Office Action mailed by the Korean Patent Office dated Jan. 14, 2020, which corresponds to Korean Patent Application 10-2018-0109512 and is related to U.S. Appl. No. 16/112,428.

* cited by examiner

DOUBLE HEAD DRILLING DEVICE AND METHOD FOR PRODUCING A BORE

The invention relates to a double head drilling device for a drill rod having an outer pipe and an inner rod running at least in sections inside the outer pipe, with a first drive unit for driving the inner rod in a rotating manner and a second drive unit for driving the outer pipe in a rotating manner.

The invention further relates to a method for producing a bore, in which a drill rod having an outer pipe and an inner rod running at least in sections inside the outer pipe is set into rotation and moved axially by means of a double head drilling device.

A generic drilling device is known from DE 10 2006 059 171 B3. This known drilling device has a first drive for driving an outer pipe. The first drive unit is of annular design, with an inner rod protruding through the first drive unit up to a second drive unit which drives the inner rod in a rotating manner. By means of a positioning cylinder the rear second drive unit is axially movable with respect to the front first drive unit so that the inner rod can be adjusted axially relative to the outer pipe. The axial adjustment is limited by the stroke length of the positioning cylinder.

A rotary drive arrangement for a drill rod having an outer pipe and an inner rod can be taken from EP 1 936 109 A1. In this rotary drive arrangement a rotary drive unit for an outer rod and a rotary drive unit for an inner rod are arranged in an axially fixed manner with respect to each other. The inner rod protrudes through both drive units and is supported with the rear end in a terminal bearing housing. By means of a positioning cylinder the rear bearing housing and thus the inner rod can be moved axially and thus adjusted relative to the outer pipe. In this arrangement, too, the axial adjustability of the inner rod is limited by the stroke length of the positioning cylinder.

From EP 2 295 645 B1 a drilling apparatus with an auger is known. The auger is fixed on an extension rod that protrudes through the single drill drive, in which case the extension rod is designed for the torque transmission from the drill drive to the drilling tool.

From EP 2 236 734 B1 a drive unit for double head drilling can be taken, in which an angular position between an outer pipe and an inner pipe of the drill rod can be set by an adjusting means.

In double head drilling an axial relative adjustment of the inner rod with respect to an outer pipe proves to be advantageous in certain cases. For instance in the case of sandy or unstable ground it may be expedient that in order to support the borehole the outer pipe runs ahead of the inner rod with the inner drilling tool. In other cases, however, it may make sense that the inner rod with the inner drilling tool initially runs ahead of the outer drill pipe. Especially in the case of ground with a layered structure it may be necessary to support a borehole in an upper region by a drill pipe whereas in deeper ground layers of greater stability drilling out solely by means of the inner rod with an inner drilling tool may be sufficient.

The invention is based on the object to provide a double head drilling device and a drilling method related thereto, with which a particularly high application versatility in double head drilling can be reached.

Preferred embodiments of the invention are stated in the respective dependent claims.

The double head drilling device according to the invention is characterized in that for the releasable clamping of the inner rod a first clamping head and a second clamping head are provided and in that the two clamping heads are supported in an axially displaceable manner with respect to each other.

A basic idea of the invention can be seen in the fact that in a double head drilling device a releasable clamping of the inner rod is provided. For this, a first clamping head and a second clamping head are provided which are supported in an axially displaceable manner with respect to each other. By means of the at least one clamping head supported in an axially displaceable manner an axial displacement can thus be effected, which can be carried out repeatedly or stepwise due to the arrangement of two clamping heads. Thus, even with a limited construction space on the double head drilling device almost any axial adjustment of the inner rod with respect to the outer pipe can be effected. In particular, use can be made of an inner rod which protrudes through the two annular drive units and projects from the drive arrangement to the rear by as much as several meters. In principle, it is even possible to attach additional extensions at the end of the inner rod so that in the double head drilling device according to the invention almost any axial movement of the inner rod with the inner drilling tool attached thereto relative to the outer pipe, which usually is a drill pipe, is rendered possible.

A preferred embodiment of the invention resides in the fact that the two clamping heads can be actuated independently of each other for alternately clamping the inner rod. Through an alternate actuation it is ensured at all times that the inner rod is fixed axially. This prevents a slipping-through of the inner rod during introduction or withdrawal of the inner rod from a vertical or inclined borehole. In particular, the inner rod is clamped by the first clamping head when the second clamping head has reached an end position and is reset into the starting position.

According to a further development of the invention it is advantageous for the first clamping head to be firmly arranged on the first drive unit and for the second clamping head to be supported in an axially displaceable manner with respect to the first drive unit. The first clamping head can constitute a torque-transmitting connection between the first drive unit and the inner rod. The drive unit can preferably comprise a hydraulic drive with a corresponding gear transmission. When the inner rod is driven in a rotating manner the first clamping head is connected in a torque-proof manner to the inner rod while the second clamping head is released from the inner rod. For a displacement operation, however, the first clamping head is released from the inner rod while the second clamping head is connected in a force-locked manner to the inner rod so that the second clamping head can be displaced axially together with the inner rod.

According to a further development of the invention it is particularly expedient that for the displacement of the second clamping head at least one displacement cylinder is provided. By preference, two or more cylinders are provided. The cylinders can in particular be actuated hydraulically.

Another preferred embodiment of the invention resides in the fact that at least one linear guide is provided, along which the second clamping head is guided. The linear guide can extend from the rear first drive unit in the rearward direction parallel to the axis of the inner rod. The linear guide serves for holding and/or as anti-twist protection of the second displaceable clamping head.

According to an embodiment variant of the invention it is especially advantageous that in the clamped state the second clamping head is designed to hold the inner rod in an axially fixed and rotatable manner for the torque transmission of a torque from the first drive unit. For the torque transmission the first clamping head is clamped with the inner rod. In this state the second clamping head can then be released from the inner rod.

Furthermore, it is advantageous that in the clamped state the second clamping head is designed to hold the inner rod in an axially fixed and torque-proof manner. When the second clamping head is clamped with the inner rod no torque transmission can take place. For displacement of the second clamping head with the clamped inner rod the first clamping head is released from the inner rod so that the second clamping head is then displaced axially, preferably with the displacement cylinder.

Basically, the clamping head can be designed in any suitable way in order to establish a force-locked and/or form-fitting connection with the inner rod. According to an embodiment variant of the invention it is particularly expedient that the first clamping head and/or the second clamping head has at least one clamping cylinder for the force-locked clamping of the inner rod. The clamping or chucking cylinder is in particular directed transversely to the inner rod or has chucking wedges or a chucking cone. By preference, two or more clamping cylinders can also be arranged on one clamping head.

According to a further development of the invention it is particularly advantageous that the second clamping head is of annular design with a passage opening for the inner rod, wherein by means of the second clamping head the inner rod can preferably be moved into the first drive unit or moved out of the second drive unit. The inner rod can thus protrude through the annular second clamping head in the rearward direction by up to 8 m or more. Especially in the case of an ahead-running drilling tool on the inner rod, such as a drilling auger, the drilling tool can thus run ahead of the outer rod by up to several meters. The inner rod protruding through the clamping heads is preferably designed as a so-called Kelly rod that has drive keys on the outside for the torque transmission. For the torque transmission these drive keys can be in operative connection with corresponding keys on the annular drive units.

The double head drilling device according to the invention can be employed not only for the double head drilling but also for other drilling methods, for instance for a superimposition drilling.

The invention furthermore comprises a drilling apparatus having a carrier vehicle and a mast or a mounting, along which a double head drilling device is guided in a displaceable manner which, as set out beforehand, is designed according to the invention. In particular, the drilling apparatus can be used for producing bored piles in the ground. The carrier vehicle of a drilling apparatus normally has a substantially vertically directed mast, along which the double head drilling device is guided in a vertically displaceable manner. Moreover, the double head drilling device according to the invention can also be employed on a spatially adjustable mounting, as used in so-called anchor drilling apparatuses for example.

Furthermore, the invention comprises a method for producing a bore, in which a drill rod having an outer pipe and an inner rod running at least in sections inside the outer pipe is set into rotation and moved axially by means of a double head drilling device, as described beforehand. By way of this method according to the invention the advantages set out beforehand can be achieved.

A preferred embodiment of the method according to the invention resides in the fact that for displacement of the inner rod this is clamped by the second clamping head, the first clamping head is released from the inner rod and the second clamping head with the clamped inner rod is displaced axially. In this way, a safe and stepwise displacement of the inner rod is possible with the second clamping head, in which case the first clamping head constitutes a fall-through protection when the second clamping head is released again from the inner rod in order to return from an end position to a starting position for a further displacement step.

To drive the inner rod in a rotating manner this is clamped with the first clamping head. After clamping of the first clamping head the second clamping head is released from the inner rod. By way of the first drive unit a torque can then be effected via a separate torque drive means or directly via the clamping head to the inner rod.

The invention is set out further hereinafter by way of a preferred embodiment illustrated schematically in the drawing.

Figure 1:
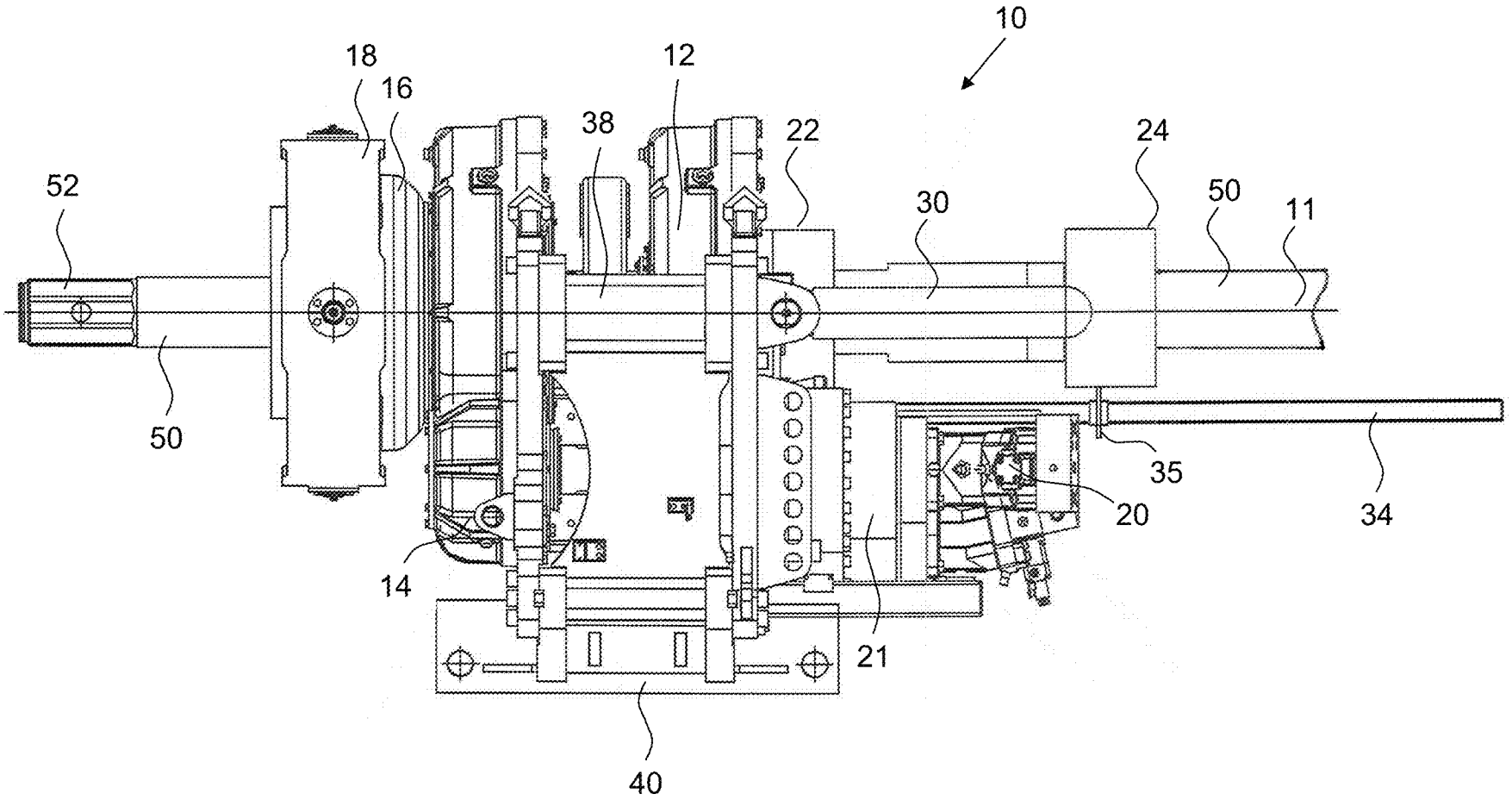
FIG. 1 shows a side view of a double head drilling device 10 according to the invention.
Figure 3:
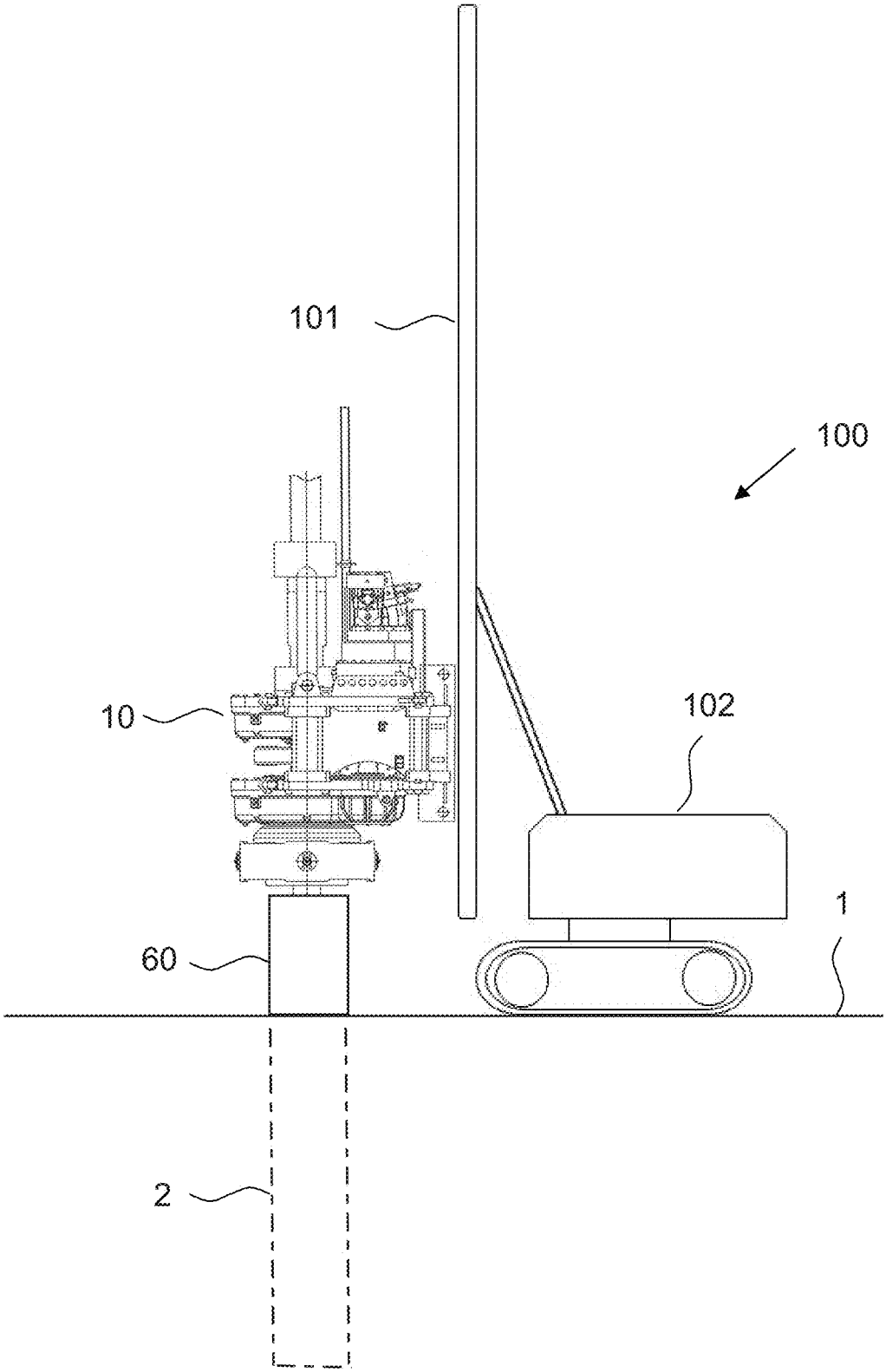
FIG. 3 shows a system overview showing the drilling device 10 in relation to a ground being drilled.

As shown in FIG. 1, the double head drilling device 10 has a carriage 40, with which the double head drilling device 10 can be moved linearly along a mast 101 of a drilling apparatus 100, as shown in FIG. 3. As shown in FIG. 3, the drilling apparatus 1 is configured to produce a borehole 2 and has a carrier vehicle 102 and the mast 101 or a mounting, along which the double head drilling device 10 is guided in a displaceable manner. In particular, the drilling apparatus 100 can be used for producing bored piles in the ground 1. The carrier vehicle 102 of the drilling apparatus 100 normally has a substantially vertically directed mast 101, along which the double head drilling device 10 is guided in a vertically displaceable manner.

Figure 2:
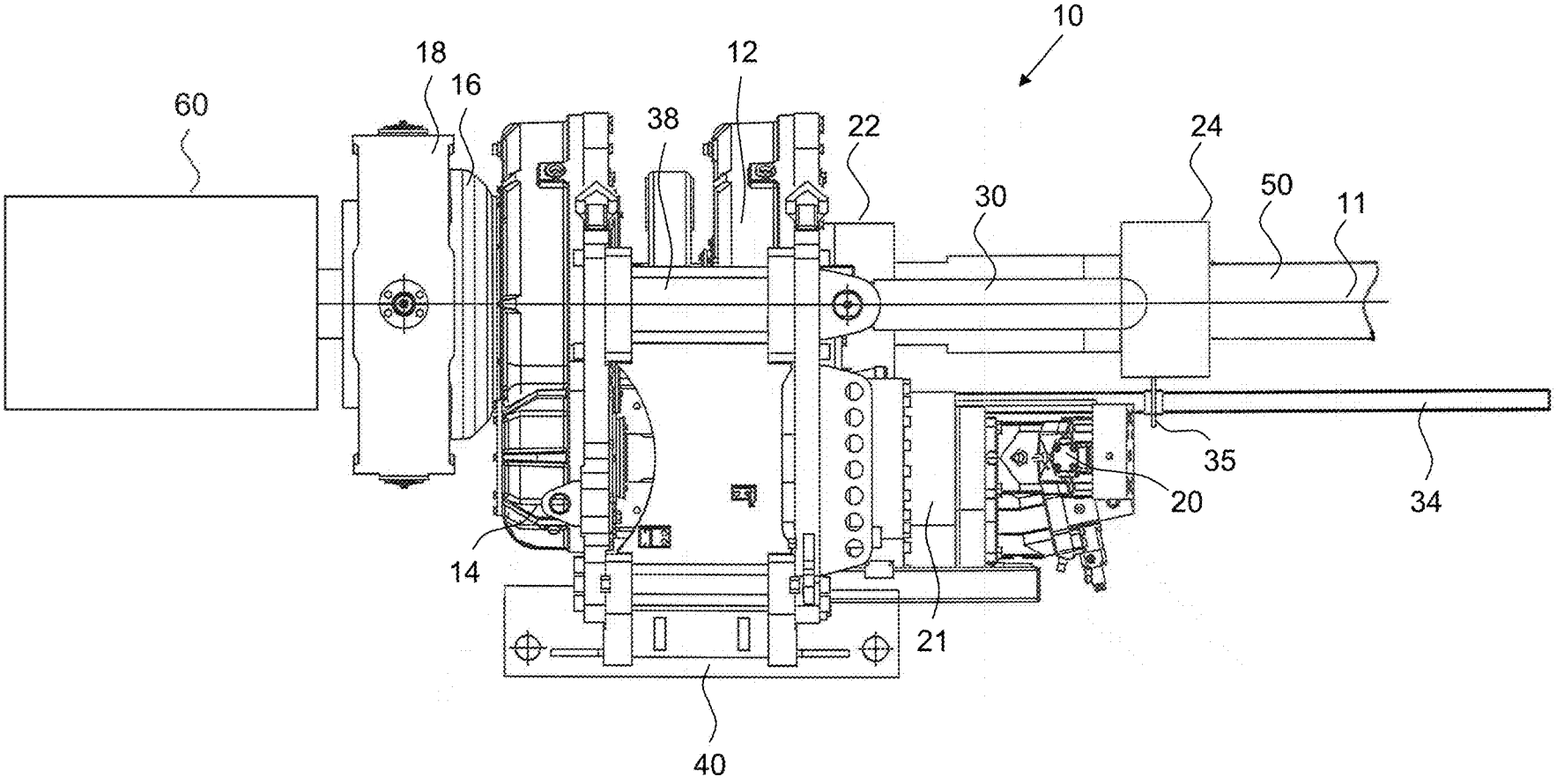
FIG. 2 shows a side view of a double head drilling device 10 shown in FIG. 1 with an outer pipe.

The double head drilling device according to the invention comprises a first drive unit 12 and a second drive unit 14. The second drive unit 14 is designed with an annular drive flange 16, to which a cardanic swivel joint 18 is attached. On the swivel joint 18 an outer pipe 60, also referred to as drill pipe, is fixed which is not illustrated in FIG. 1 for reasons of clarity but shown in FIG. 2. By means of the second drive unit 14 the outer pipe 60 can be driven in a rotating manner in order to be drilled into the ground.

The first drive unit 12 is designed for driving a cylindrical inner rod 50. The inner rod 50 protrudes through the double head drilling device 10 with the annular drive units 12, 14. On the illustrated front end of the inner rod 50 a polygonal connecting piece 52 is arranged, on which a drilling tool, such as a drilling auger or a drilling bucket, can be releasably fixed. The inner rod 50 can be of pipe-shaped design with an internal duct to introduce through this e.g. concrete or another hardening mass into a produced borehole 2.

The two drive units 12, 14 have annular drive wheels for the torque transmission to the inner rod 50 or the outer pipe 60. The torque is produced by rearward arranged hydraulic motors 20 that transmit the torque via a gear transmission means 21 to the drive wheels of the two drive units 12, 14. The two drive units 12, 14 are firmly connected to each other by at least one connecting bar 38. Alternatively, the two drive units 12, 14 can also be axially movable with respect to each other by way of axial positioning cylinders.

For axial movement of the inner rod 50 with respect to the outer pipe 60 an annular first clamping head 22 is arranged at the rear end of the first drive unit 12. In the clamped state the first clamping head 22 can hold the inner rod 50 such that it is axially fixed but rotatable about a drilling axis 11. Moreover, axially spaced thereto a second clamping head 24 is arranged that can clamp the inner rod 50 in an axially fixed and torque-proof manner. The second clamping head 24 can preferably be of annular or of another design.

When a second clamping head 24 is clamped and a first clamping head 22 is released, the second clamping head 24, together with the clamped inner rod 50, can be displaced axially by means of a displacement cylinder 30 between a starting position and an end position. In this, the second clamping head 24 is guided in a torque-proof manner by a guide shoe 35 along a bar-shaped linear guide 34.

Thus, with the second clamping head 24 the inner rod 50 can be displaced axially according to the stroke of the displacement cylinder 30. Afterwards, the second clamping head 24 can be released again and returned to the starting position. During this return movement process the inner rod 50 can be clamped and fixed in the position by the first clamping head 22. Subsequently, a renewed clamping by the second clamping head 24 can take place, in which case the first clamping head 22 is released again from the inner rod 50. Henceforth a displacement step can again be carried out by the second clamping head 24 with the displacement cylinder 30.

In this way, an inner rod 50 of almost any length that protrudes through both drive units 12, 14 and both clamping heads 22, 24 can be used in double head drilling. Through repeated stepwise displacement of the inner rod 50 with respect to the outer pipe 60 a drilling tool can run ahead by almost any length with respect to the lower end of the outer pipe 60.

The invention claimed is:

1. A double head drilling device for a drill rod having an outer pipe and an inner rod running at least in sections inside the outer pipe, the device comprising:

a first drive unit for driving the inner rod in a rotating manner, and a second drive unit for driving the outer pipe in a rotating manner, wherein for a releasable clamping of the inner rod a first clamping head and a second clamping head are provided, the first and second clamping heads are supported in an axially displaceable manner with respect to each other, and the second clamping head is configured to clamp the inner rod and to be displaced axially with the clamped inner rod with respect to the outer pipe while the first clamping head is released from the inner rod.

2. The double head drilling device according to claim 1, wherein the first and second clamping heads can be actuated independently of each other for alternately clamping of the inner rod.

3. The double head drilling device according to claim 1, wherein the first clamping head is firmly arranged on the first drive unit and the second clamping head is supported in an axially displaceable manner with respect to the first drive unit.

4. The double head drilling device according to claim 1, wherein for displacement of the second clamping head at least one displacement cylinder is provided.

5. The double head drilling device according to claim 1, wherein at least one linear guide is provided, along which the second clamping head is guided.

6. The double head drilling device according to claim 1, wherein in a clamped state the first clamping head is designed to hold the inner rod in an axially fixed and rotatable manner for a torque transmission of a torque from the first drive unit.

7. The double head drilling device according to claim 1, wherein in a clamped state the second clamping head is designed to hold the inner rod in an axially fixed and torque-proof manner.

8. The double head drilling device according to claim 1, wherein the first clamping head and/or the second clamping head is configured to be connected in a force-locked manner to the inner rod.

9. The double head drilling device according to claim 1, wherein the second clamping head is of annular design with a passage opening for the inner rod, wherein by means of the second clamping head the inner rod can be moved stepwise into the first drive unit or moved out of the second drive unit.

10. A drilling apparatus having:

a carrier vehicle and a mast or a mounting, along which a double head drilling device is guided in a displaceable manner, wherein the double head drilling device according to claim 1 is provided.

11. A method for producing a bore, comprising:

setting a drill rod having an outer pipe and an inner rod running at least in sections inside the outer pipe into rotation, and moving the drill rod axially by means of the double head drilling device according to claim 1.

12. The method according to claim 11, wherein for displacement of the inner rod, the inner rod is clamped by the second clamping head, the first clamping head is released from the inner rod, and the second clamping head with the clamped inner rod is displaced axially.

* * * * *